United States Patent [19]

O'Dea et al.

[11] Patent Number: 4,655,133

[45] Date of Patent: Apr. 7, 1987

[54] INK FOUNTAIN ASSEMBLY AND SEGMENTED FILM METERING, BLADE

[75] Inventors: Kevin J. O'Dea, Mystic, Conn.; David J. McCooey, Westerly, R.I.

[73] Assignee: Harris Graphics Corporation, Melbourne, Fla.

[21] Appl. No.: 822,945

[22] Filed: Jan. 27, 1986

Related U.S. Application Data

[63] Continuation of Ser. No. 665,961, Oct. 29, 1984, abandoned.

[51] Int. Cl.[4] ..... B41F 31/04

[52] U.S. Cl. ..... 101/363; 101/365

[58] Field of Search ..... 101/157, 169, 205, 206, 101/207, 208, 350, 351, 363, 364, 365; 411/337, 340, 366, 427; 33/154 E, 154 F, 154 G; 403/21, 60, 118

[56] References Cited

U.S. PATENT DOCUMENTS

| | | | |
|---|---|---|---|
| 625,318 | 5/1899 | Bradford | 101/350 |
| 1,574,474 | 2/1926 | Faltus | 101/365 |
| 1,778,476 | 10/1930 | Wood | 101/365 |
| 2,583,640 | 1/1952 | Faeber | 101/365 |
| 2,887,049 | 5/1959 | Mueller | 101/364 |
| 3,280,466 | 10/1966 | Heimberger | 411/427 X |
| 3,730,090 | 5/1973 | Lamberg et al. | 101/365 |

FOREIGN PATENT DOCUMENTS

| | | | |
|---|---|---|---|
| 1053530 | 3/1959 | Fed. Rep. of Germany | 101/169 |

*Primary Examiner*—Charles A. Pearson

*Attorney, Agent, or Firm*—Tarolli, Sundheim & Covell

[57] ABSTRACT

An ink fountain for printing presses is disclosed in which a plurality of metering segments extend along the surface of the fountain roll to control the thickness of the ink film applied to the roll. The metering segments are individually adjustable toward and away from the fountain roll surface by screw and nut actuators in combination with springs which bias the segments toward the fountain roll. Precise positioning of the segments with respect to the roll is provided because the spring takes up all backlash within the actuator threads and any play in the connection between the actuator and the segments and trough. The actuator is structured to prevent actuator-produced forces on the segment in the direction of the roll so that the maximum force of engagement is provided by the spring. The ink trough and segment assembly is pivoted for movement to a service position in which the segments can be removed and replaced without disassembly of the trough assembly.

7 Claims, 4 Drawing Figures

INK FOUNTAIN ASSEMBLY AND SEGMENTED FILM METERING, BLADE

This is a continuation of co-pending application Ser. No. 665,961 filed on Oct. 29, 1984, now abandoned.

BACKGROUND OF THE INVENTION

This invention relates generally to printing presses, and more particularly to a novel and improved system for metering the supply of ink applied to a fountain roll.

Prior Art

It is know to provide an assembly of metering segments extending across a printing press fountain roll to meter the ink on such roll. Such segments are normally individually adjustable toward and away from the roll so that the amount of ink applied to each zone on the roll aligned with each segment can be individually controlled. Examples of such systems are illustrated in U.S. Pat. Nos. 3,312,166; 3,559,573; 3,978,788; 4,000,695; and 4,058,058. In some such systems, such as those illustrated in U.S. Pat. Nos. 4,241,691 and 4,328,748, a spring is employed to bias the metering segments toward the fountain roll and in the latter of such above-mentioned patents, a power actuator is employed to overcome the spring force and pull the metering segments back from the roll.

In order for such systems to function well, it is necessary to position the metering edge with respect to the roll surface with extreme accuracy. For example, if the metering edge is not exactly parallel to the roll surface, the ink film will vary in thickness across the blade's width. Further, if a screw-type actuator is used to move the metering segments toward and away from the fountain roll, backlash or clearance of the screw threads can result in poor control of the ink film thickness.

SUMMARY OF THE INVENTION

There are several important aspects to the present invention. In accordance with one important aspect of the invention, a novel and improved metering segment positioning system is provided. Such system provides a spring applying a spring force to the metering segment, urging the associated segments toward the fountain roll surface in combination with a screw-type actuator which operates to adjust the spacing between the metering edge of the metering segment and the fountain roll surface.

Extreme accuracy of the position of the metering segements is provided in accordance with this aspect of this invention because the spring provides a preload on the actuator which takes up all of the clearances in the threads and in the connections between the actuator and the segments and base. The spring, therefore, eliminates backlash-caused positional inaccuracy of the metering segments, as well as any positional inaccuracy resulting from clearances in the various connections. This allows the use of actuator parts which need not be manufactured with extreme precision without the loss of accurate metering. Consequently, the manufacturing costs are reduced and a reasonable amount of wear can be tolerated, so maintenance costs are also reduced.

The actuator system is also arranged so that it cannot cause a metering segment to engage the fountain roll surface with excessive force, and thereby prevents unnecessary damage to either part. In accordance with the illustrated embodiment of this invention, the maximum force that may be applied to the metering segment in the direction of the fountain roll surface is the force of the spring, and the actuator screw cannot apply a force to the metering segment in the direction of the fountain roll surface.

In accordance with another aspect of this invention, a pivot connection is provided between the actuator and the metering segment in which the only force that can be applied from the actuator to the metering segment is in the direction toward or away from the surface of the fountain roll. Therefore, the metering segments of the system are free to align themselves with respect to the fountain roll surface. Such structural arrangement allows the metering segments to float within limits and to compensate for variations in the size and shape of the metering segments resulting from manufacturing tolerances or the like.

In accordance with still another aspect of this invention, a novel and improved system is provided in which the metering segments can be easily removed and replaced without any substantial disassembly of the fountain structure. In the illustrated embodiment, metering segment removal is accomplished by simply pivoting the fountain down away from the fountain roll so as to provide access to the metering segments and threading the metering segment off the end of the drive screw of the actuator.

These and other aspects of the invention are illustrated in the accompanying drawings, and are more fully described in the following specification.

DETAILED DESCRIPTION OF THE DRAWINGS

Figure 1:
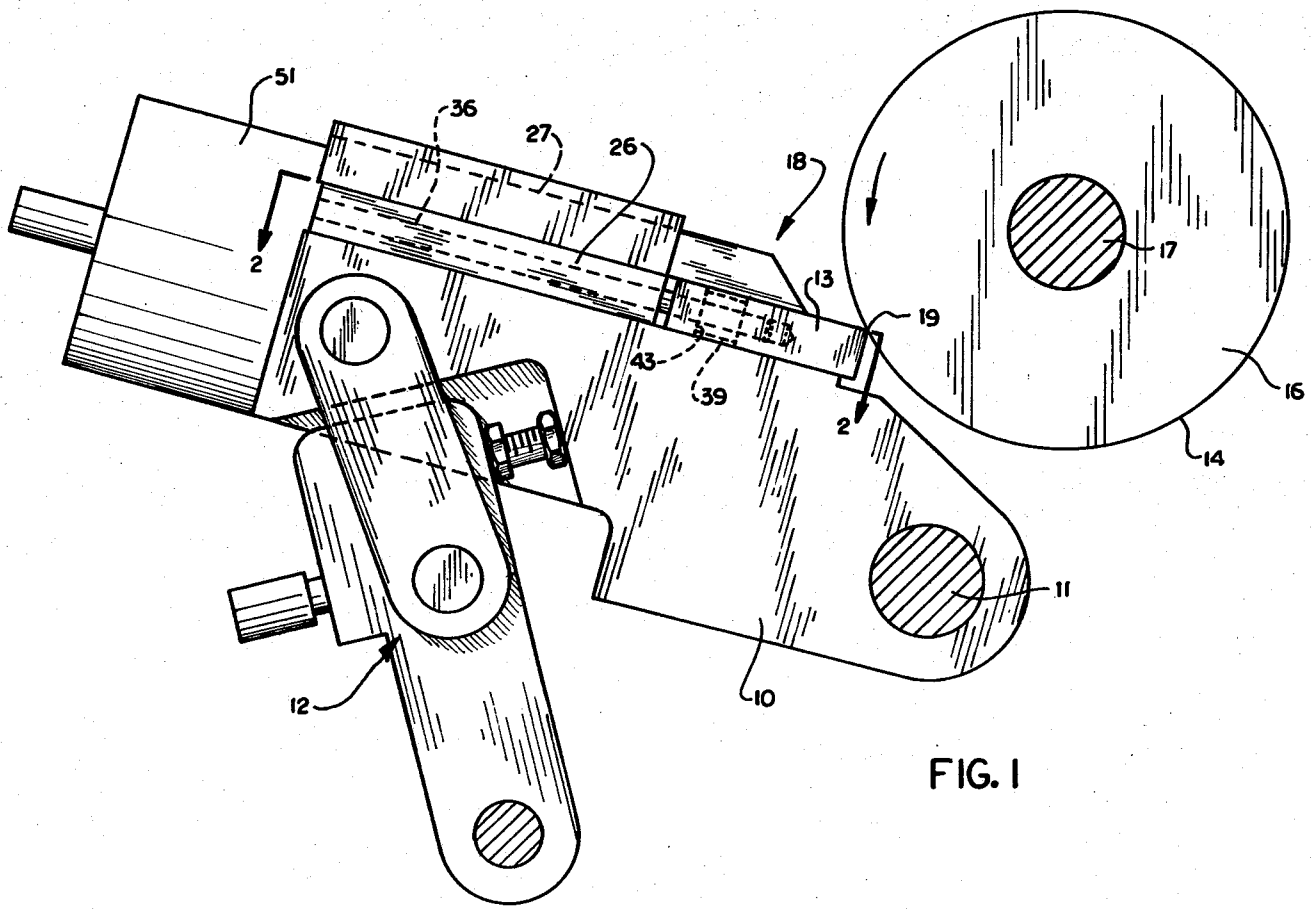
FIG. 1 is a side elevation of an ink fountain in accordance with the present invention, with parts removed for purposes of simplification of the drawings.

FIG. 1 illustrates an ink fountain in accordance with the present invention in its normal operative position. The fountain includes a frame or housing 10 which is journaled on a pivot 11 and is releasably locked in its operative position by a toggle assembly 12. In such operative position, metering segments 13 are positioned adjacent to the surface 14 of a fountain roll 16. The fountain roll is supported on a shaft 17 for rotation about the axis of such shaft.

When the fountain roll rotates in an anti-clockwise direction as illustrated in FIG. 1, ink contained within the ink trough, indicated generally at 18, is carried along the surface 14 of the fountain roll past the metering edge 19 of the metering segments for subsequent transfer to other rolls (not illustrated).

A plurality of similar metering segments 13 are positioned in alignment along the length of the housing 10 and cooperate to establish the desired film thickness of the ink on the surface 14. The individual metering segments are individually adjustable toward and away from the surface 14 so as to permit variations in the ink film thickness at various zones along the length of the fountain roll adjacent to the individual metering segments.

Figure 2:
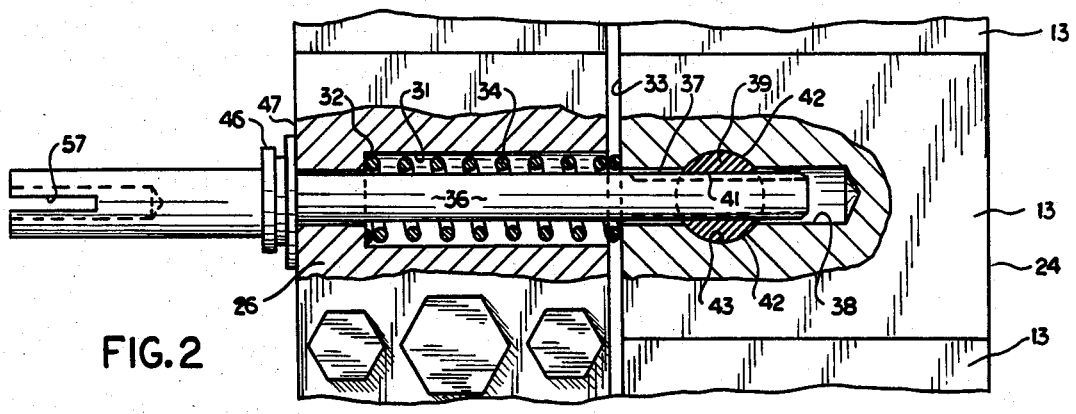
FIG. 2 is a fragmentary view taken along line 2—2 of FIG. 1 illustrating the actuation system for the metering segment.
Figure 3:
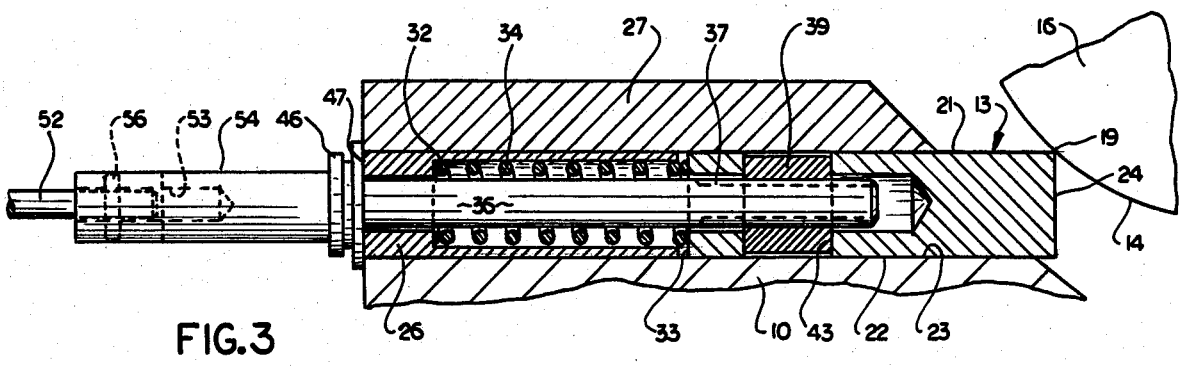
FIG. 3 is a side elevation of the actuator system in longitudinal section.

Referring to FIGS. 2 and 3, the metering segments 13 are rectangular blocks providing an upper surface 21 and a parallel lower surface 22, the latter of which engages a support surface 23 on the housing 10. The metering edge 19 is formed by the intersection of the upper surface 21 and a forward end surface 24.

A spacer plate 26 is positioned across the housing 10 behind the segments 13 and is also supported on the surface 23 of the housing 10. The thickness of the spacer plate 26 is slightly greater than the thickness of the metering segments 13 so that a cover plate 27 mounted on the upper surface of plate 26 extends along the upper surface 21 of the metering segments 13 with slight clearance so that the metering segments can be adjusted. The cover plate and the surface 23 cooperate to provide opposed guide surfaces which guide the metering segments in their movement toward and away from the fountain roll surface 14.

The spacer plate 26 is provided with a step bore 31 in alignment with the center of each of the metering segments 13 providing a shoulder 32 spaced back from the rearward surface 33 of the metering segments 13. A spring 34 is positioned within the step bore 31 and extends between the shoulder 32 and the rearward surface 33. The spring 34 is sized so that it is compressed in position and exerts a spring force on the associated metering segment 13, urging such metering segment in a direction toward the fountain roll surface 14.

A screw actuator is provided for each of the metering segments and includes a screw 36 provided with threads 37 at its forward end. Such screw 36 extends with clearance through the step bore 31 and the spring 34 into a blind bore 38 in the associated metering segment 12. Such blind bore 38 is sized to provide clearance with respect to the screw 36.

A nut 39 provides a threaded bore 41 which receives the threads 37 of the screw 36. Such nut is provided with a cylindrical outer surface 42 which is positioned in a cross bore 43 in the associated metering segment 13. Such cylindrical nut and cross bore provide a pivot connection between the nut 39 and the associated metering segment 13. Further, the height of the nut 39 is selected to be less than the thickness of the metering segment 13, as best illustrated in FIG. 3, so that the nut is free to float within the cross bore 43.

A shoulder 46 is provided on the rearward end of the screw 36 and is normally held by the spring 34 in engagement with the rearward surface 47 of the spacer plate 26. Engagement between the shoulder 46 and the surface 47 limits the movement of the screw 36 to the right (as viewed in FIGS. 2 and 3) to the position illustrated in such figures. However, the structure of the screw is such that the screw can move against the action of the spring 34 to the left from the illustrated position, as discussed in greater detail below.

In order to adjust the metering segments 13 toward and away from the fountain roll, each screw is provided with a motor 51 providing an output shaft 52 (illustrated in FIG. 3) which fits into a bore 53 in the outer end 54 of the screw and provides a cross pin 56 which is positioned in an axial slot 57 in the end of the screw. In its position, the cross pin 56 is spaced from the inner end of the slot and the drive shaft 52 is spaced from the inner end of the bore 53 so that the motor allows the screw 36 to move to the left from the illustrated position.

With the illustrated structure, each of the springs 34 provides a spring bias on the associated metering segment urging such metering segment toward the surface 14 of the fountain roll. The screw 36 in cooperation with a nut 39, however, operates to overcome the action of the spring 34 and moves the metering segment 13 against the action of the spring away from the surface 14 of the fountain roll 16 to the desired adjusted position. In such condition, however, all of the backlash in the threads of the screw 36 and nut 39 are taken up by the force of the spring. Further, any looseness between the nut 39 and the cross bore 43 is also taken up by the action spring. Consequently, each metering segment 13 is precisely positioned with respect to the surface 14 by the screw 36 and nut 39 associated therewith.

In order to assure that all clearances and backlash are taken up, each spring 34 is selected to provide a force sufficient to overcome any hydrodynamic forces in the blade and to assure that the position of the metering segment is accurately and precisely determined by the adjustment of the associated actuator system.

It should be noted that excessive forces cannot be developed by the adjustment system of the metering segments. If the screw 36 is rotated in an extending direction after the associated metering segment engages the fountain roll, the screw merely moves back and the shoulder 46 lifts away from the rearward surface 47. Consequently, the maximum force of engagement between the edge 19 of the metering segment and the surface 14 is that force which is developed by the spring. Such force is incapable of causing material damage to the fountain roll or the metering segment. The spring system provided in accordance with the present invention has the advantage of taking up all clearances and backlash so as to create precise positioning of the blades and also ensures that the blade cannot be forced into damaging contact with the fountain roll.

Further, with the structure in which the nut is cylindrical and is positioned in a pivotal manner within the cross bore 43, the actuator cannot exert any forces on the associated metering segment except forces in the direction of the axis of the screw. Consequently, each of the metering segments is free to float with respect to the trough housing assembly and to align itself properly with the surface 14 of the fountain roll. Consequently, slight imperfections in the dimensional accuracy of the various components of the system do not adversely effect the accuracy of the metering of the ink.

Preferably the metering segments are sized as to provide a small amount of lateral clearance within the assembly and such clearance is filled with a grease to prevent leakage of the ink. Further, a greasing system substantially as illustrated in U.S. Pat. No. 4,000,695 may be ultilized to ensure that a good coating of grease is maintained along the various surfaces of the metering segments to prevent objectionable leaking of ink through the clearances between mating surfaces. Such patent is incorporated by reference for such disclosure.

Figure 4:
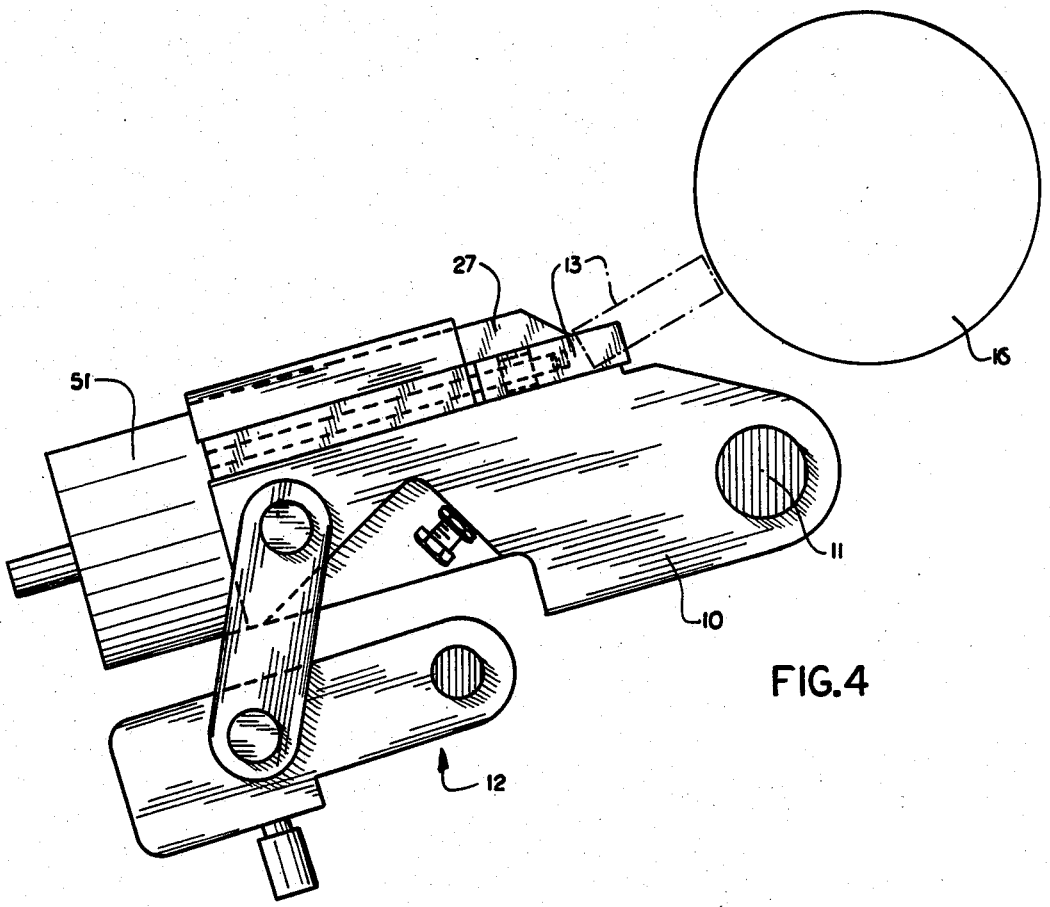
FIG. 4 is a view similar to FIG. 1 in which the fountain trough is lowered to permit removal and replacement of metering segments.

As best illustrated in FIG. 4, the toggle 12 can be released to allow the housing 10 to pivot down around the pivot 11 to a lowered or service position illustrated in which the metering segments can be easily removed. In such position, the cover plate is spaced back from the fountain roll a distance at least as great as the length of the metering segments. When segment removal is required, the screw associated with the particular metering segment that is to be removed is rotated until the nut 39 threads off the end of the screw 36. The segment is then merely lifted out, as illustrated in phantom, and removed from the machine. Subsequently, a replacement metering segment can be reinstalled and coupled by merely threading the screw into the nut mounted within the metering segment. Ater reinstallation or servicing of the metering segments, the housing 10 is raised up to its operative position of FIG. 1 and the toggle 12 locks it in such position.

With this system in which the housing assembly can be dropped down as a unit, it is a simple matter to service the metering segments without any substantial disassembly of the remaining components of the system.

Although the preferred embodiment of this invention has been shown and described, it should be understood that various modifications and rearrangements of the parts may be resorted to without departing from the scope of the invention as disclosed and claimed herein.

What is claimed is:

1. An ink fountain for printing presses comprising a fountain roller journaled for rotation, an ink trough adjacent to said roller, a plurality of metering segments mounted on said ink trough for movement generally in a plane toward and away from the fountain roller to form a metering gap, said fountain roller in cooperation with said trough and metering segments defining an ink reservoir for containing ink which coats the surfaces of said fountain roller as said fountain roller rotates, screw thread actuators associated with metering segments, each thread actuator comprising a nut pivotally connected to an associated metering segment for allowing said associated metering segment to pivot in a later plane to align itself with respect to said fountain roller and a screw connected to said trough, said segments having a predetermined clearance therebetween to provide for pivoting of said associated segment, and means for effecting relative rotation between said screw and nut in one direction for moving said associated metering segment toward said fountain roller and in the other direction opposite to said one direction for moving said associated metering segment away from said fountain roller, said nut being formed with a cylindrical exterior surface positioned within a cross-bore in said associated metering segment to provide a pivot connection between said nut and said associated metering segment, said nut have a central axis generally perpendicular to the plane of movement of said metering segment, and said nut and said bore being located entirely between front and rear edges of said metering segment.

2. An ink fountain as set forth in claim 1, wherein said metering segments are removable by threading the associated nuts off the associated screws.

3. An ink fountain as set forth in claim 2, wherein said trough is pivotally mounted for movement between an operative position and a service position, and said metering segments are removable from said trough without disassembly thereof while said trough is in said service position.

4. An ink fountain as set forth in claim 3, wherein lock means are provided to releasably lock said trough in said operative position.

5. An ink fountain as set forth in claim 1 wherein said means for effecting relative rotation between said screw and nut comprises a motor for rotating said screw and means for allowing relative axial movement between said motor and screw.

6. An ink fountain as set forth in claim 1 including spring means for urging said metering segment toward said fountain roller.

7. An ink fountain for printing presses comprising a fountain roller journaled for rotation, an ink trough adjacent to said roller, a plurlity of metering segments mounted on said ink trough for movement generally in a plane toward and away from said fountain roller to form a metering gap, said fountain roller in cooperation with said trough and metering segments defining an ink reservoir for containing ink which coats the surfaces of said fountain roller as said fountain roller rotates, screw thread actuators associated with each metering segment comprising a nut pivotally connected to an associated metering segment for allowing said associated metering segment to pivot in a lateral plane to align itself with respect to said fountain roller and a screw connected to said trough, and means for effecting relative rotation between said screw and nut in one direction for moving said associated metering segment toward said fountain roller and in the other direction opposite to said one direction for moving said associated metering segment away from said fountain roller, said nut being formed with a cylindrical exterior surface positioned within a cross-bore in said associated metering segment to provide a pivotal connection between said nut and said associated metering segment, said nut having a height that is less than thickness of said associated metering segment to enable said nut to float in said cross-bore, said nut having a central axis generally perpendicular to the plane of movement of said metering segment, and said nut and said bore being located entirely between front and rear edges of said metering segment.

* * * * *